United States Patent [19]

Reta

[11] Patent Number: 4,805,393

[45] Date of Patent: Feb. 21, 1989

[54] STRING CONSTRUCTION FOR A SPORTS RACKET

[76] Inventor: Marcos A. Reta, 1900 W. 54th St., Apt. 208, Hialeah, Fla. 33012

[21] Appl. No.: 158,955

[22] Filed: Feb. 22, 1988

Related U.S. Application Data

[63] Continuation-in-part of Ser. No. 934,311, Nov. 20, 1986, abandoned.

[51] Int. Cl.[4] ..... D02G 3/34; D02G 3/44

[52] U.S. Cl. ..... 57/248

[58] Field of Search ..... 57/200, 206, 207, 234, 57/248, 251; 428/395, 397, 400; 264/171, 177.1, 177.13

[56] References Cited

U.S. PATENT DOCUMENTS

| | | | |
|---|---|---|---|
| 2,401,291 | 5/1946 | Smith | 57/251 X |
| 2,434,533 | 1/1948 | Wurzburger | 57/248 X |
| 3,720,055 | 3/1973 | Mestral et al. | 57/248 |
| 3,802,954 | 4/1974 | Orito et al. | 57/248 X |
| 3,918,247 | 11/1975 | Riley et al. | 57/248 |
| 4,016,714 | 4/1977 | Crandall et al. | 57/234 |
| 4,288,977 | 9/1981 | Czarki et al. | 57/248 X |
| 4,306,410 | 12/1981 | Nakamura et al. | 57/207 X |
| 4,565,061 | 1/1986 | Durbin | 57/251 X |
| 4,639,397 | 1/1987 | Sato et al. | 428/397 |
| 4,449,353 | 5/1984 | Tayebi | 57/234 X |

FOREIGN PATENT DOCUMENTS

| | | | |
|---|---|---|---|
| 17569 | 8/1969 | Japan | 264/177.13 |

*Primary Examiner*—Donald Watkins

*Attorney, Agent, or Firm*—John Cyril Malloy

[57] ABSTRACT

A construction of a string of the type used with a plurality of other such strings, in connected fashion across the head of a sports racket, such as a tennis racket or the like, wherein the string construction is defined to include various structural components to enable an interaction between the strings and a ball being struck thereby so as to make it easier to control the flight of the ball, after it is struck and also to overcome any natural derogatory tendency of a person's swing that would tend to derogatorily affect the flight of the ball.

19 Claims, 2 Drawing Sheets

STRING CONSTRUCTION FOR A SPORTS RACKET

BACKGROUND OF THE INVENTION

This is a continuation in-part-application of Ser. No. 934,311 filed Nov. 20, 1986, now abandoned, by the inventor herein.

FIELD OF THE INVENTION

This invention relates to a construction for a string of the type used to cover the face of a tennis racket or like sports racket to the extent that interaction between a plurality of such strings and a ball or like object being struck will make it easier for a player to impart the desired flight characteristics to the ball and thereby make playing of a game, such as tennis, easier.

DESCRIPTION OF THE PRIOR ART

Games such as tennis which require the use of a sports racket having a plurality of strings connected across the face of the head portion thereof and used to strike a ball, generally appear to be quite simple, at least in theory, to play. However, actual practice of these games and more particularly the development of consistent expertise in placement of the ball, after hitting, is in reality quite difficult. In large part, the difficulty in playing such games is derived from the fact that a natural tendency of a player's swing and the size, configuration of the ball as well as the court itself make expert placement of the ball, after being struck, quite difficult. For example, in the game of tennis, one standing behind the base line on a tennis court would have to have a height of at least six foot seven inches to see any part of the opponents court without looking through the net. Normally, balls are hit by the racket at about waist level. Such balls have to clear the net and still land within the opposing players court boundaries. Such dimension and configuration limitation are problems with which a player has to contend in addition to the speed and "spin" placed on the ball by the opposing player and the court itself once the court comes in contact therewith.

With a flat racket face and conventional strings, one would have to swing upwards when meeting the ball at an angle of approximately seventeen degrees just to counteract the aforementioned spin put on the ball by the court. This would result in hitting a ball with absolutely no rotation on it as it attempts to fly to the other side of the net. Unfortunately, the height of the net, gravity and limits of human strength will more often than not result in a "netted" ball. These are some of the reasons why so many balls end up either at the net, because of not enough top spin, or out of bounds due to opening the racket face in attempt to clear the net and have gravity take over so that the ball will land within the court boundaries. Based on today's aggressive style of play, it is frequently required, regardless of a players expertise, to hit a ball which is spinning from a low to high vertical axis or top spin generating downward force, so that the path of the ball will resemble the arch of a rainbow. This is much more difficult to accomplish when the outer surface of the strings connected across the face of the racket are in fact smooth and include no additional or supplementary structure therein which aids in the interaction or "grabbing" of the ball by the strings once so struck.

Accordingly, there is a need for a string construction to be used on sports rackets such as but not limited to tennis rackets, which allows one to swing naturally in a primarily horizontal plane. Such a string construction, due to the increase friction of the string when contacting the ball, multiplies the effect of the small amount of upward swing of the racket causing the ball to arch over the net and still land within the boundaries of the opposing players court.

SUMMARY OF THE INVENTION

The present invention is directed towards a string having a specifically defined construction so as to cause a "grabbing" or interaction of frictional engagement between the plurality of strings mounted across the face of a sports racket. In order to accomplish preferred flight characteristics and overall better control of the flight of the ball, by striking it, the present invention deviates from conventional racket string construction by providing an other than smooth exterior surface, varying the cross-sectional configuration of the string and providing other integrally formed structural features thereof. This will aid in the frictional contact, grabbing effect, etc. of the strings on the surface of the ball to enhance its flight characteristic.

More specifically, in various embodiments of the present invention, the cross-sectional configurational is preferably a multi-sided configuration in the preferred form of a triangular, rectangular or square wherein the outer surface configuration of the string, in one embodiment is defined by a single filament. It should be noted, however, that the cross-sectional configuration could be substantially circular. The outer configuration is in the form of a helical twist extending continuously along the length of the string between opposite ends thereof. As will be pointed-out in greater detail hereinafter, the number of "twists" along the length of the string could vary, preferably between 2 and 200 per foot. Other features included along with the helically formed configuration of the outer surface may be the provision of a plurality of indentations or "apertures" extending from the outer surface inwardly into the interior of the string in preferred predetermined distance. Further, the indentations are spaced apart from one another within predetermined distance parameters such that the indentations are also arranged in a somewhat helical array from one opposite end of the single filament of the string to the other.

In addition to the indentation, a channel structure may also be formed in the outer surface of the string and also has a preferred helical configuration. In the embodiments so described, hereinafter, the channel and the helical configured array of indentations are continuously disposed in spaced-apart relation to one another a common distance along the length of the string or single filament and are cooperatively disposed, dimensioned and structured so as to provide a preferred frictional engagement between a plurality of such strings, when "strung" across the face of a sports racket and the surface of the ball itself when struck thereby.

Accordingly, using a racket wherein the face of the head portion thereof comprises a plurality of such interconnected strings of the construction set forth herein will help neutralize the effects of gravity on the ball, after being struck and also will help minimize the height of the net as a factor when it is required to propel the struck ball across the net into a preferred location in the opposing players court. Also, the effect of the flight of the ball when utilizing a string construction of the present invention will make it easier to control the length of the flight and avoid the ball flying outside the court boundaries. Concurrently, the derogatory effects of the counter spin of the ball traveling towards a player will be overcome as well as the natural tendency of a player to swing in a horizontal plane.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which:

FIG. 32 is yet another embodiment of the present invention wherein a plurality of filaments form the subject string construction.

Like reference numerals refer to like parts throughout the several views of the drawings.

DETAILED DESCRIPTION OF THE PREFERRED EMBODIMENT

As shown in the various figures hereinafter, the present invention is directed towards a construction for a string of the type specifically designed for use in the "stringing" of the face of a sports racket head, such as but not limited to a tennis racket. In the embodiments of FIGS. 1 through 34, the construction of each of the individual strings, generally represented as 10, comprises a single filament 12 having a specific cross-sectional configuration. More specifically, in the embodiments of FIGS. 1 through 14, the cross-sectional configuration is triangular and is represented as 14. In the embodiments of FIGS. 15 through 26, the cross-sectional configuration is square and is represented as 16. The embodiments of FIGS. 27 through 34 the cross-sectional configuration is not multi-sided but substantially round or circular and is represented as 18.

Figures 2, 3, 4, 6, 7, 8, 9, 11, 12, 13, 14:
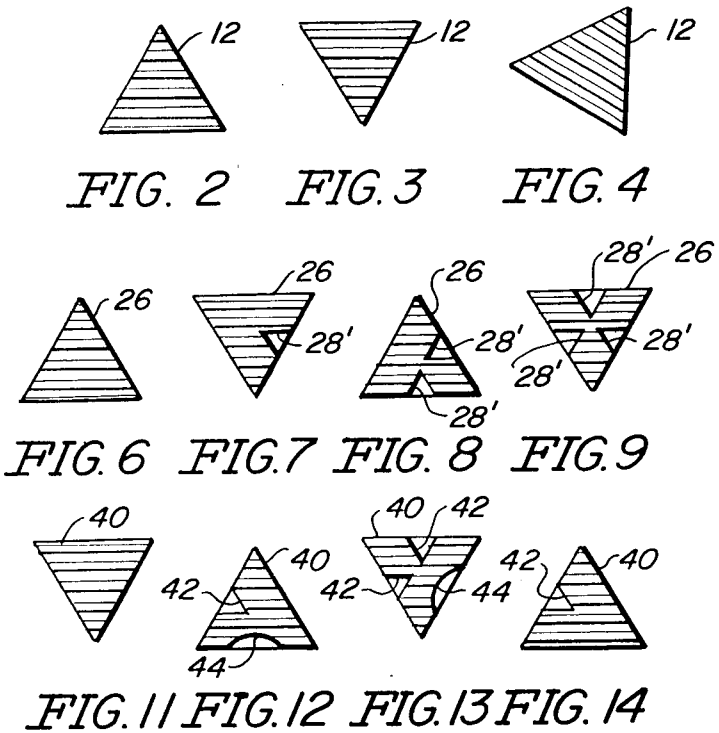
FIGS. 2 through 3 are sectional views taken along the appropriate designated line of the embodiment of FIG. 1.
FIGS. 6 through 9 are sectional views taken along the respectively indicated lines of the embodiment of FIG. 5.
FIGS. 11 through 14 are cross-sectional views taken along of the respectively indicated lines of the embodiment of FIG. 10.
Figures 1, 5, 10, 15:
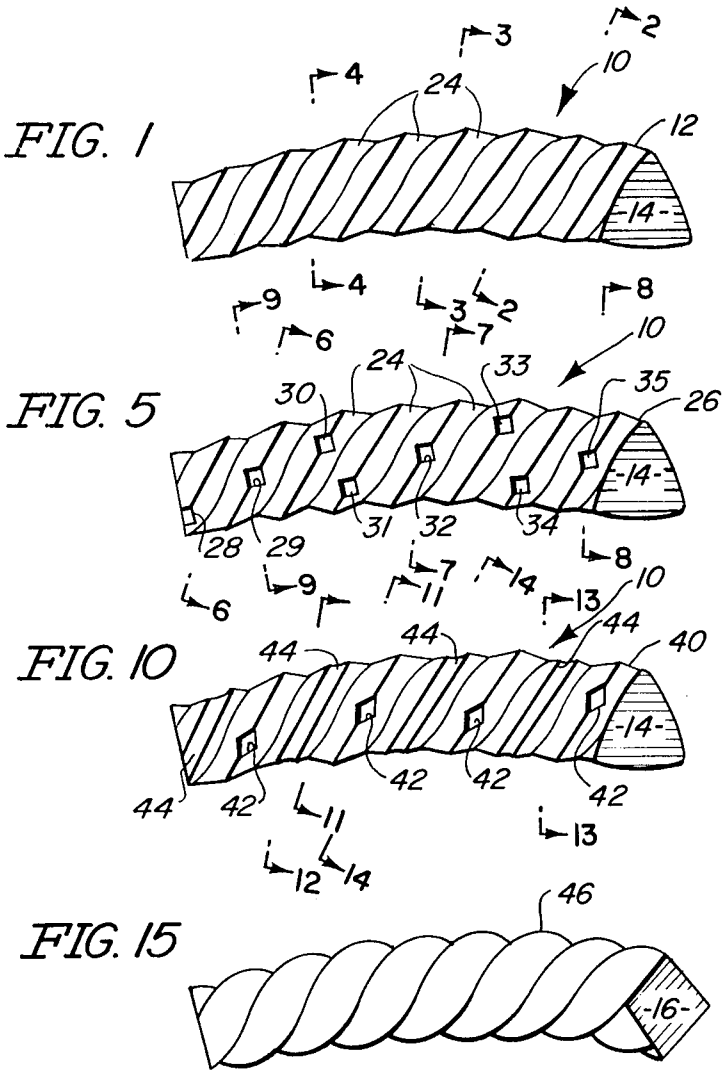
FIG. 1 is a schematic representation of one embodiment of the present invention having a specific cross-sectional configuration thereof.
FIG. 5 is yet another embodiment of a string construction of the present invention.
FIG. 10 is yet another embodiment of the present invention.
FIG. 15 is yet another embodiment of the present invention.
Figures 16, 17, 18, 19, 20, 21, 22, 23, 24, 25, 26, 27, 28, 29, 30, 31, 32, 33, 34, 35, 36, 37:
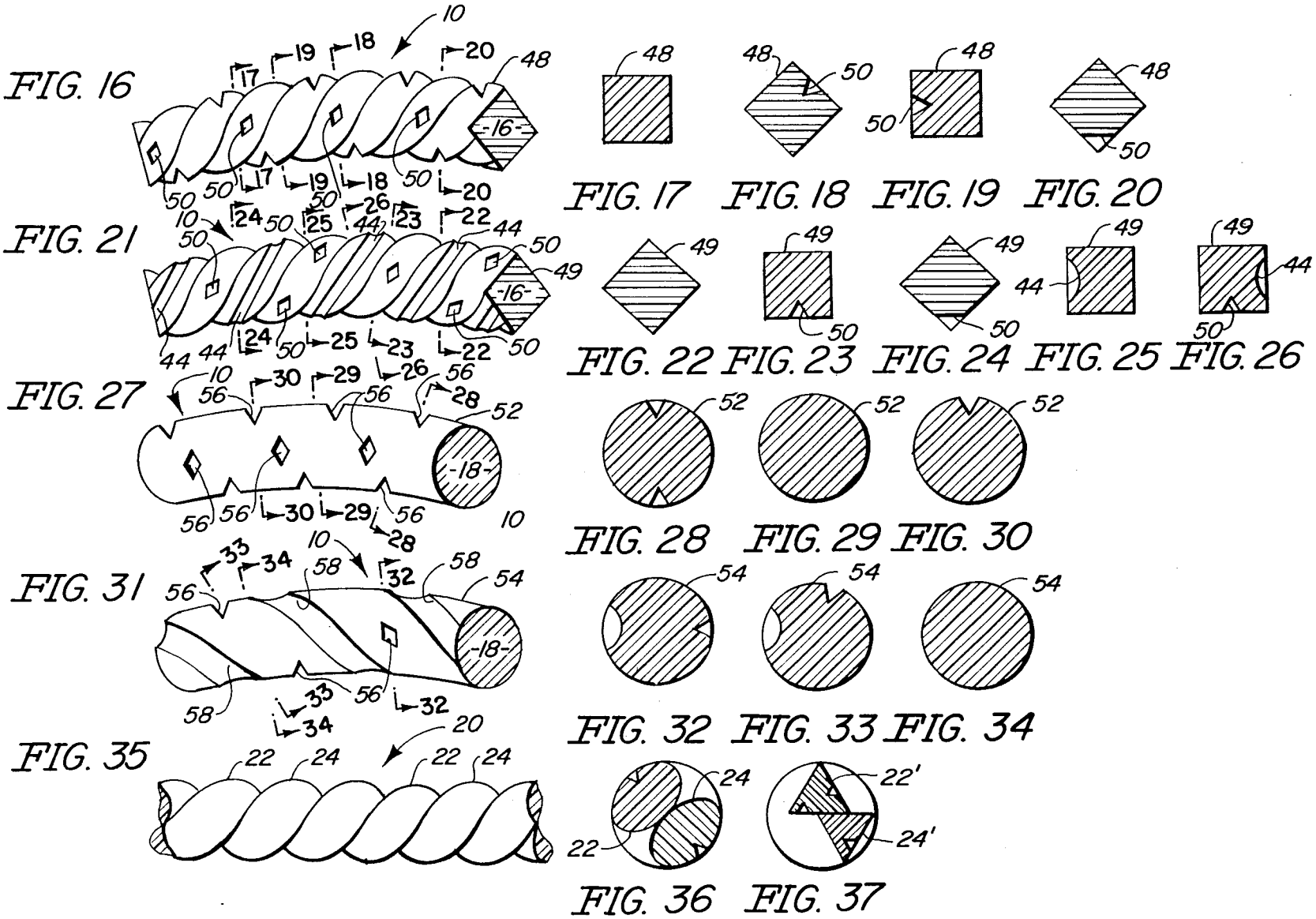
FIGS. 16 is yet another embodiment of the present invention.
FIGS. 17 through 20 are cross-sectional views taken along the appropriate respective lines indicated in the embodiment of FIG. 16.
FIG. 21 is yet another embodiment of the present invention.
FIGS. 22 through 26 are cross-sectional views along the appropriately designated lines of the embodiment of FIG. 21.
FIG. 27 is yet another embodiment of the present invention.
FIGS. 28 through 30 are appropriate cross-sectional views along the respectively designated lines of the embodiment of FIG. 27.
FIG. 31 is yet another embodiment of the present invention.
FIGS. 32 through 34 are cross-sectional views along the respective indicated lines of the embodiment of FIG. 31.
FIG. 36 is a variety of the embodiment of FIG. 35 wherein the cross-sectional configuration of each of the plurality of filaments are substantially circular.
FIG. 37 is yet another embodiment of the present invention wherein the cross-sectional configuration of the plurality of filaments of the embodiment of FIG. 35 are primarily multi-sided.

The embodiments of FIGS. 35, 36 and 37 differ from the previous noted and designated embodiments of FIGS. 1 through 34 in that the string generally indicated as 20 includes a plurality of separate filaments, preferably two in number and designated 22 and 24 (FIGS. 35 and 36) and 22' and 24' (FIG. 37). As shown in FIG. 1, the exterior surface of the string 10 includes an outer surface configured in the form of a helical twist 24 extending along the length of the string between opposite ends thereof. In addition, the number of "twists" formed in and defining the configuration of the outer surface in this embodiment and the others described hereinafter, may preferably vary from 2 to 200 per foot of length of the string. For purposes of clarity, FIGS. 2, 3 and 4 show various cross-sectional configurations throughout the respectively designated section lines as indicated in FIG. 1.

FIG. 5 shows another embodiment of the present invention wherein the single filament defining the string construction and indicated as 26 also includes the outer surface configuration in the form of a helical twist 24 but also includes a plurality of indentations 28 represented consecutively in a substantially helical array and in spaced relation to one another by the numbers 28, 29, 30, 31, 32, 33, 34 and 35. It should be noted that of course all of the indentations formed in the single filament defining the string construction as at 26 are not shown since only effectively one side of the string 10 is represented in FIG. 5. Accordingly, in cross-section of FIGS. 7, 8 and 9, each of the indentations are represented by the same reference numeral 28', noting that the different locations will depend upon the position or orientation of the filament 26 of the string construction 10. Further with regard to the embodiment of FIG. 5 as well as the other embodiments including the indentations as designated above, each of the indentations are oriented in a substantially perpendicular relation to a central longitudinal axis of the filament, regardless of the embodiment in which they are represented. Also in the embodiment of FIG. 5, the indentations are disposed in spaced-apart relation to one another a distance at least one-fifth of the circumference of the string 10 or single filament 26 wherein such distance is measured between adjacent, consecutive ones of the plurality of indentations.

With regard to the embodiment of FIGS. 10 through 14, a filament 40 of the string 10 comprises the plurality of indentations 42 successively arranged in a substantially helical array as they extend along the length of the filament 40. In addition, a helical configured continuously disposed channel 44 is integrally formed in the outer surface and extends into the interior thereof and is further disposed in spaced relation to the helical array or configuration of indentations 42. In each of the embodiments comprising the indentation as described above and to be described in greater detail hereinafter, another dimensional feature of the indentations is their inward extension into the interior of the respective strings 10 a distance of at least one-fifth of the transverse dimension of the respective filament or string.

With regard to FIG. 15, the subject embodiment as disclosed therein comprises a square cross-sectional configuration with a helical configured twist-like outer surface configuration defining a single filament 46 as shown. Further, the multi-sided square cross-sectional configuration 16 is further represented in the embodiments of FIGS. 16 through 26 wherein the embodiment of FIG. 16 also includes a plurality of spaced-apart indentations 50 formed in the single filament 48. The embodiment of FIGS. 21 through 26 discloses a single filament construction 49 including a plurality of indentations 50 disposed in a substantially helical configuration extending along the length of the filament 49 and further wherein a helical configured or oriented channel 44 is also formed in the outer surface of the filament 49 and extends in spaced relation to the helical array of indentations 50 along the entire length of the filament 49 defining the string 10.

With regard to the embodiments of FIGS. 27 through 30 and the additional embodiments of FIGS. 31 through 34, both are somewhat similar in that they include a single filament having a circular or substantially round cross-sectional configuration extending continuously along the length thereof. In the embodiment of FIGS. 27 through 30 the outer surface of the filament 52 further includes a plurality of indentations 56 but is absent the helical twist outer surface configuration.

The embodiments of FIGS. 31 through 34 includes both the indentations 56 and the continuously helical configured channel 58. In the embodiment of FIG. 35 a plurality, preferably two filaments 22 and 24 are interwound in a twisted fashion to define a helical twist in the outer surface configuration of the string 20. In the embodiment of FIG. 35 and as shown more specifically in FIGS. 36 and 37 the filaments may include a circular cross-sectional configuration 20 as shown FIG. 36 and represented as 22 and 24 or a multi-sided and preferably triangular cross-sectional configuration 22' and 24'. Suffice it to say that although not clearly shown, each of the filaments 22 and 24 as well as 22' and 24' may also include the plurality of indentations integrally formed therein as well as the helically configured channel formed therein.

Now that the invention has been described,

What is claimed is:

1. A construction for a string for use on a sports racket and designed, when connected in combination with a plurality of other such strings on the head portion of the racket, for the striking of a ball or like object, said construction comprising:

a. a common, substantially multi-sided cross-sectional configuration extending continuously along the length of the string, b. an outer surface including a helical oriented twist configuration extending along the length of the string continuously between opposite ends thereof, c. a plurality of indentation formed on said outer surface and extending inwardly into the interior of the string, and d. each of said plurality of indentations spaced successively from one another about the outer periphery of said outer surface and collectively extending along the length of the string.

2. A construction for a string as in claim 1 wherein each of said plurality of indentations extend inwardly into the interior of said string in substantially perpendicular relation to a central longitudinal axis of the string.

3. A construction for a string as in claim 2 wherein each of said plurality of indentations are spaced from a next adjacent indentation by a distance of at least one-fifth of the circumference of the string.

4. A construction for a string as in claim 2 wherein said plurality of indentations extend into the string a distance of substantially at least one-fifth the transverse dimension of the string.

5. A construction for a string as in claim 1 further comprising a continuous channel formed in said outer surface and extending into the interior thereof to a common depth along the length of the string, said channel having a substantially continuous helical configuration along the length of the string.

6. A construction for a string as in claim 5 wherein said plurality of indentations are collectively arranged in a substantially helical array and are disposed in spaced relation to said channel between adjacent segments thereof.

7. A construction for a string as in claim 6 wherein said helical array of indentations and said helical configuration of said channel extend continuously in adjacent, commonly spaced relation to one another along the length of the string.

8. A construction for a string as in claim 7 wherein said string comprises a common substantially triangular cross-sectional configuration extending along its length.

9. A construction for a string as in claim 7 wherein said string comprises a common, substantially square cross-sectional configuration extending along its length.

10. A construction for a string as in claim 1 comprising a plurality of filaments each having a common, multi-sided, cross-sectional configuration extending continuously along its length, said plurality of filaments twisted in a helical orientation relative to one another along the length of the formed string between opposite ends thereof, a plurality of indentations formed on an outer surface of the twisted filaments and extending inwardly into the interior of the respective filaments in which they are formed, each of said plurality of indentations spaced successively from one another about the outer periphery of said outer surface and collectively extending along the length of the formed string.

11. A construction for a string as in claim 10 wherein each of said plurality of indentations extend inwardly into the interior of said formed string in substantially perpendicular relation to a central longitudinal axis thereof.

12. A construction for a string as in claim 11 wherein each of said indentations extend inwardly a distance at least one-fifth of the transverse dimension of the respective one of said filaments.

13. A construction for a string as in claim 11 wherein each of said plurality of indentations are spaced from a next adjacent indentation by a distance substantially at least one-fifth the circumference of said respective one of said filaments.

14. A construction for a string as in claim 10 wherein at least one of said filaments has a common multi-sided configuration extending along its length.

15. A construction for a string as in claim 14 wherein said one filament has a common, substantially triangular configuration extending along its length.

16. A construction for a string as in claim 14 wherein said one filament has a common, substantially square configuration extending along its length.

17. A construction for a string as in claim 14 wherein said one filament has a common, substantially rectangular configuration extending along its length.

18. A construction for a string as in claim 1 wherein said helical oriented twist configuration of the outer surface of said string is defined by a plurality of twists disposed in adjacent engagement with one another, each of said plurality of twists collectively extending continuously along the length of the string and ranging in number from 2 to 200 per foot of length of the string.

19. A construction for a string for use on a sports racket and designed, when connected on the head portion of the racket, for the striking of a ball or like object, said construction comprising:

a. a common substantially multi-sided cross-sectional configuration extending continuously along the length of the string, b. an outer surface including a helical oriented twist configuration extending along the length of the string continuously between opposite ends thereof, c. said helical oriented twist configuration defined by a plurality of twists disposed in adjacent engagement with one another, and d. said plurality of twists collectively extending continuously along the length of the string and ranging in number from 2 to 200 per feet of length of the string.

* * * * *